United States Patent [19]

Bright et al.

[11] 4,137,735

[45] Feb. 6, 1979

[54] CLOTHES WASHER TUB HAVING IMPROVED WASHABILITY MEANS

[75] Inventors: James A. Bright, Dayton; Homer W. Deaton, Bellbrook, both of Ohio

[73] Assignee: General Motors Corporation, Detroit, Mich.

[21] Appl. No.: 840,773

[22] Filed: Oct. 11, 1977

[51] Int. Cl.[2] ..... D06F 13/04; D06F 39/06

[52] U.S. Cl. ..... 68/18 D; 68/23.6; 210/380 L

[58] Field of Search ..... 68/18 D, 23.6, 23.7, 68/208; 210/380 L, 382, 383

[56] References Cited

U.S. PATENT DOCUMENTS

| | | | |
|---|---|---|---|
| 1,751,982 | 3/1930 | Dunham | 210/380 L X |
| 2,366,236 | 1/1945 | Clark | 68/23.2 X |
| 3,245,505 | 4/1966 | Staengle et al. | 68/23.6 X |
| 3,616,662 | 11/1971 | Brucken | 68/18 D |

*Primary Examiner*—Philip R. Coe
*Attorney, Agent, or Firm*—Edward P. Barthel

[57] ABSTRACT

A domestic clothes washer has an outer imperforate water container to retain the washing fluid and an inner perforate spin tub which is rotatable to centrifuge the washing fluid from clothes being washed therein. A vertically reciprocating agitator in the inner spin tub provides a pulsating toroidal circulation of washing fluid. The spin tub has a perforate generally vertical side wall and an imperforate bottom wall joined thereto by a curved wall portion containing a circumscribing row of holes positioned thereon located so as to carry particulate matter from the spin tub during wash periods while minimizing undesirable back flow through the row of holes during spin periods of the tub.

1 Claim, 4 Drawing Figures

CLOTHES WASHER TUB HAVING IMPROVED WASHABILITY MEANS

This invention relates to domestic clothes washers and more particularly to an improved spin tub for clothes washers employing a vertically reciprocating agitator.

As explained in U.S. Pat. No. 3,616,662, to Byron L. Brucken, assigned to the assignee of the present application, the removal of sediment such as sand from domestic clothes washers has long been recognized as a problem. The prior art Brucken patent solution to this problem involved a spin tub having a substantially perforate side wall to facilitate centrifuging while including a substantially imperforate bottom wall so that the washing energy in pulsating currents of washing fluid would not be dissipated. The Brucken patent provided an annular step and hole arrangement in the bottom wall of the inner spin tub which created eddy currents over the holes during each pulse of washing fluid to trap sediment in the outer water container.

The present invention is directed to a spin tub which has a substantially perforate side wall and an imperforate bottom wall joined by a radiused wall portion having a row of spaced apertures therein with the row of apertures located such that or causing a velocity vector of washing fluid outwardly through the row of apertures during reciprocation of the agitator to remove from the tub any sediment contained within tub while the row of holes is located such that there is insufficient velocity vector of washing fluid inwardly through the apertures during rotation or spin cycle of the tub to return any of the sediment during reciprocation of the washer agitator.

Accordingly, it is a general object of the present invention to provide an improved spin tub for a clothes washer having a cylindrical side wall and an imperforate bottom wall joined by a curved wall portion formed with a circumscribing row of holes positioned thereon whereby an outward velocity vector during the washing cycle carries sediment from the inner spin tub to an outer water container so as to minimize backflow through the row of holes during rotation of the spin tub.

A more specific object of the present invention is the provision of an improved domestic clothes washer having an outer water container and an inner spin tub having a perforate cylindrical side wall and an imperforate bottom wall joined by a radiused wall portion between the perforate side wall and the imperforate bottom wall having a single row of equally spaced and coplaner apertures therein around the spin tub. A vertically reciprocating agitator in the spin tub creates a pulsating toroidal circulation of washing fluid wherein said single row of apertures being characterized by a location sufficiently radially outward on said radiused wall portion such that there is a velocity vector of washing fluid outwardly through said single row of apertures during reciprocation of the agitator of sufficient magnitude to remove from the spin tub any sediment removed from the clothes, and whereby said single row of apertures being further characterized in being located sufficiently radially outward that due to the spin created water pressure gradient in the tub that there is insufficient velocity vector of washing fluid inwardly through said row of apertures during rotation of the spin tub to return to the tub any of the sediment removed previously to the water container during reciprocation of the agitator.

Further objects and advantages of the present invention will be apparent from the following description, reference being had to the accompanying drawings wherein a preferred embodiment of the present invention is clearly shown.

Figure 1:
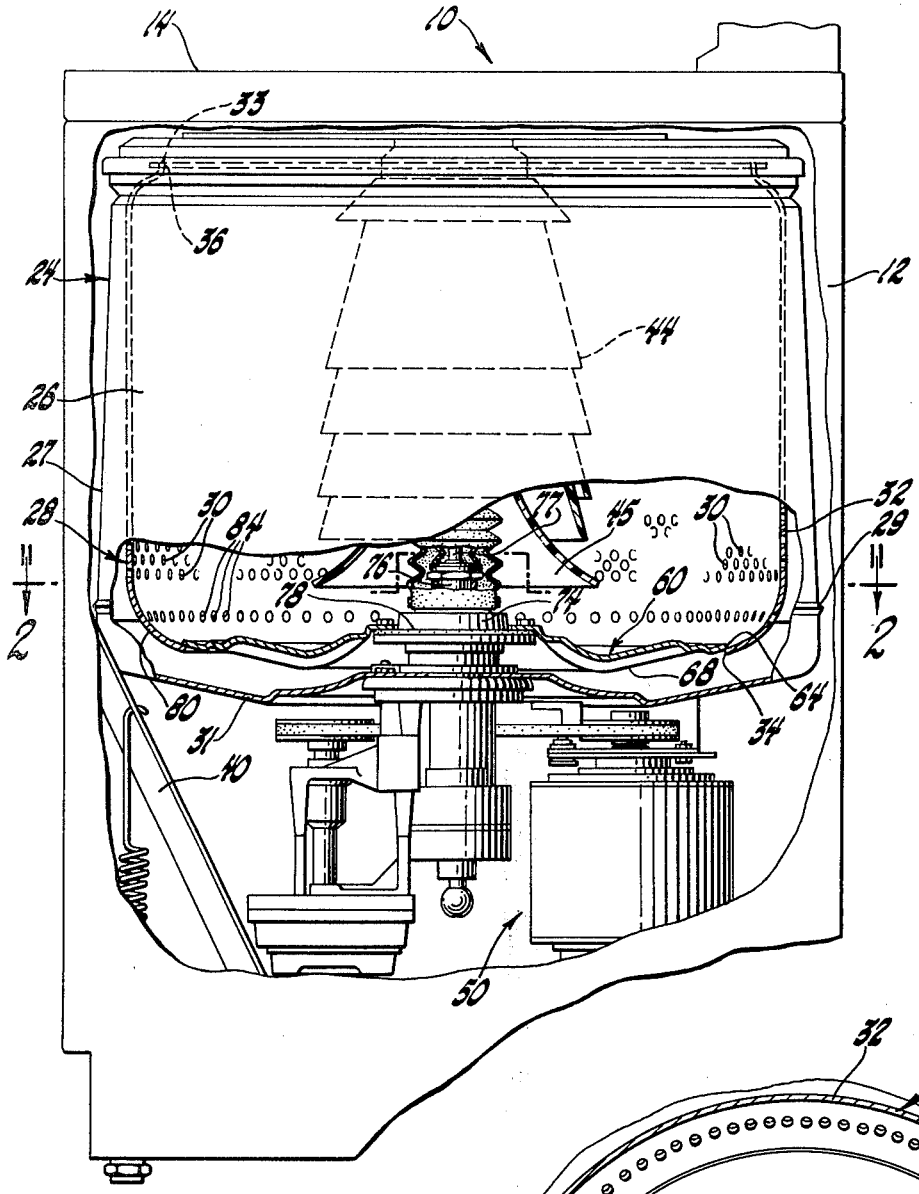
FIG. 1 is a fragmentary side elevational view of a domestic clothes washer, with parts broken away, to show a tub assembly incorporating a sediment removal means of this invention.
Figure 2:
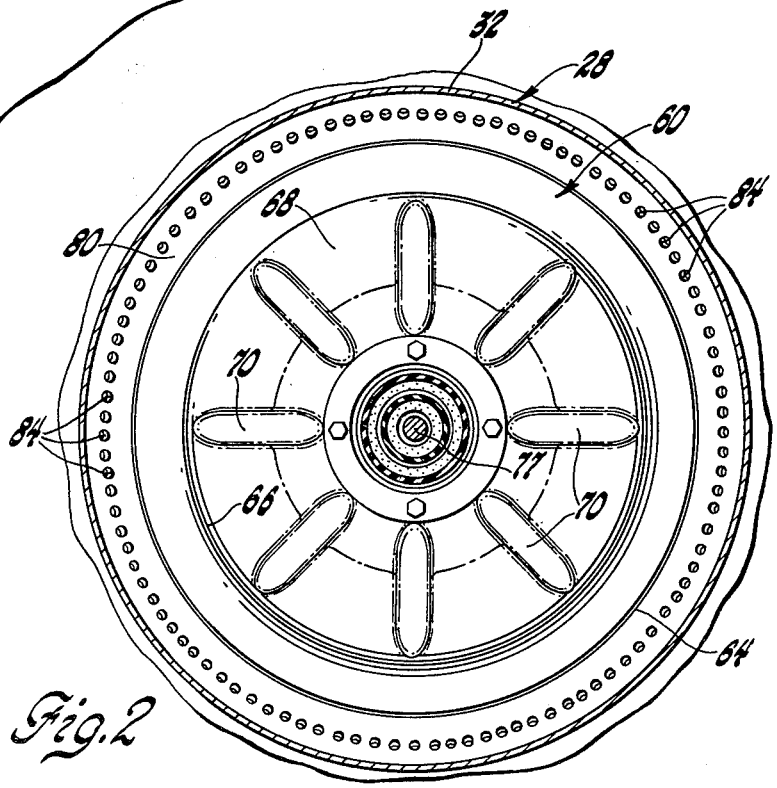
FIG. 2 is a sectional view taken along the line 2—2 of FIG. 1 to show the bottom wall and radiused portion of the spin tub of this invention.

In accordance with this invention and with reference to FIG. 1, a domestic clothes washer is shown generally at 10. The washer includes a box-like sheet metal casing 12 having a top wall 14.

The casing 12 is shown to enclose a nested tub assembly 24. The assembly includes an outer imperforate tub or water container 26 and a perforate inner tub or spin tub 28. Perforations 30 are coextensive with a cylindrical side wall 32 of the spin tub. The side wall 32 is curved inwardly at its lower end to form an open-bottom 34 and at its upper end to form a rim 33 which defines an open-top 36. Spin tub 28 is approximately 16 inches deep, has a perforate side wall 32 twenty-two inches in diameter and eleven inches high and a top opening 36 provided by a rim 33 which is about nineteen inches in diameter. The open bottom 34 of the spin tub is 17.5 inches in diameter. The side wall 27 of the water container is substantially fifteen inches high from its top to its jointure 29 with the bottom wall 31. Side wall 27 diverges in the fifteen inches from a diameter of twenty-three inches at its top to a diameter of twenty-four inches at its bottom.

The tub assembly 24 is mounted on a suspension system shown generally at 40 and more fully taught in U.S. Pat. No. 3,493,118 granted Feb. 3, 1970. The tub assembly includes an agitator 44 which with the spin tub 28 is connected to a power means generally at 50. The power means includes a drive mechanism which may be of a roller drive type taught more fully in U.S. Pat. No. 3,087,321, granted Apr. 30, 1963. In general, the power means 50 may be operated in one manner to vertically reciprocate or oscillate the agitator 44 for washing clothes in the tub assembly. When the power means is operated in another manner, the spin tub 28 is rotated with respect to the water container 26 for centrifuging washing fluid from the clothes in the spin tub. The foregoing should provide a sufficient understanding of the environment in which the present invention is used. For additional details, reference may be had to the U.S. Pat. Nos. 3,663,975 and 3,618,344, commonly assigned with this application.

As stated in the mentioned Brucken patent, the problem in the foregoing washer is to get rid of normally insoluble sediment such as sand, without dissipating the cleaning energy of the pulsating currents of washing fluid. Such energy dissipation is most pronounced where the spin tub is substantially perforated in the area receiving the most forceful currents of washing fluid from the agitator. Too many perforations or holes in this area reduce the cleaning effect of the agitator. In the clothes washer 10 the pulsating current are caused by vertically reciprocal agitator or pulsator 44. The water container 26 contains nineteen to twenty gallons of washing fluid at maximum fill. With the power means 50 operating to reciprocate the agitator 44 at three hundred sixty strokes per minute, an eighteen pound clothes load will turn over inside the spin tub in the toroidal circulation about one third to one-half times per minute or five to seven times per fifteen minute wash cycle. As you open up the bottom of the spin tub with holes to release sediment, you lose turnover and washability. Moreover, clothes tend to hang up on the holes of an extensively perforated bottom and circulation of washing fluid tends to take place between the water container and the spin tub rather than inside the spin tub.

Figure 3:
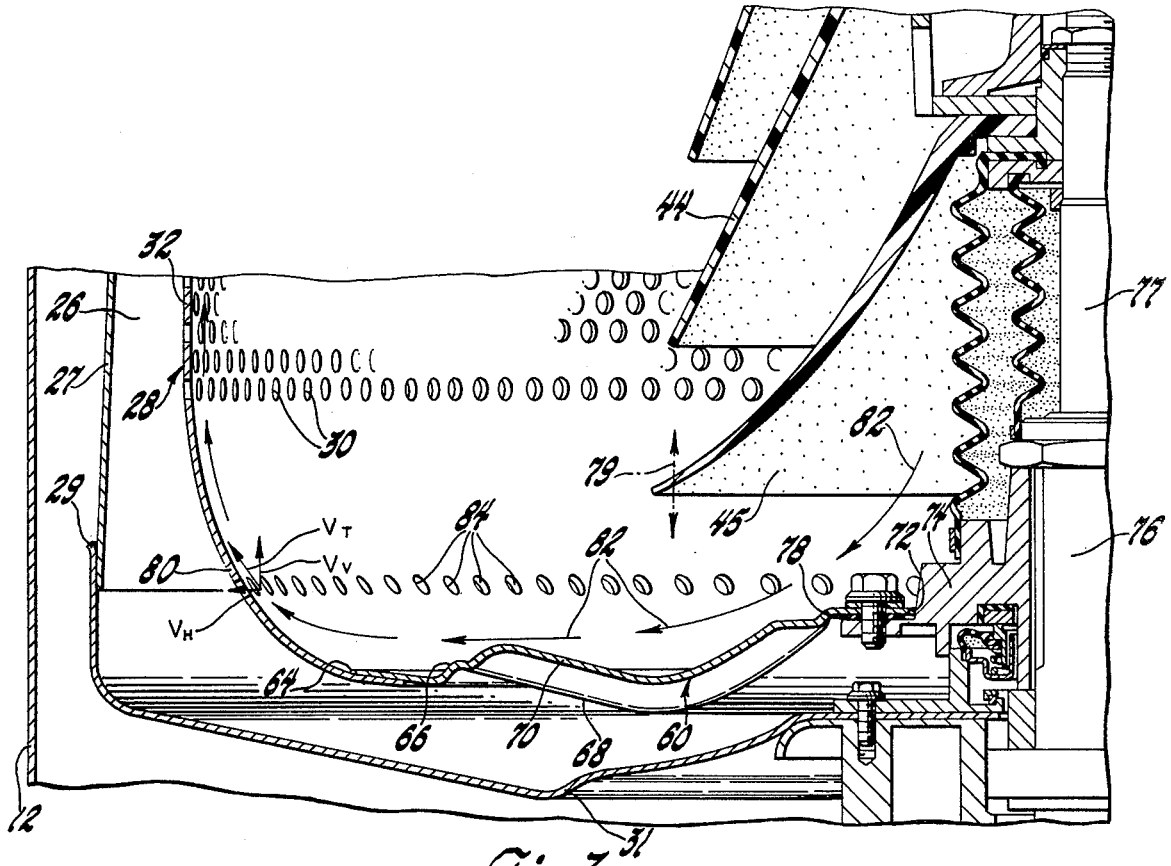
FIG. 3 is an enlarged fragmentary sectional view of a portion of the spin tub shown in FIG. 1.

Turning now to the sediment removal means of the present invention, FIG. 3, bottom wall 60 is shown to have a generally dished configuration in cross-section. An annular step 66 circumscribes the bottom wall radially outward of an imperforate dished portion 68 thereof and of the pumping ring 45 of the agitator 44 (FIG. 1). The step 66 is also outboard of a plurality of radial ribs 70 used to stiffen the bottom wall 60.

As seen in FIG. 3, the bottom wall 60 is imperforate and includes a central opening 72 in the bottom thereof for receiving spin tub securing base 74 receiving tub spin shaft 76. Agitate drive shaft 77 mounts the agitator 44 generally vertically in the spin tub with the drive means 50 selectively drivingly connected to the agitate shaft 77 for vertically reciprocating the agitator 44. It will be noted in FIG. 3 that seal means in the form of a tub support annular gasket 78 is located between the support 74 and the tub 28 to seal the tub central opening 72.

As shown in FIG. 3, the agitator 44 during the reciprocation, indicated by arrows 79, provides pulsating currents of washing fluid, indicated by arrows 82. The arrows 82 show the fluid currents moving radially outwardly in the spin tub 28 along the bottom wall 60 toward radiused wall portion 80 and upwardly along the radiused wall portion toward the side wall in a manner to induce toroidal flow of washing fluid in the tub. In the preferred embodiment the holes 84 have a diameter of about 0.1875 inches which is the same size as the holes 30 in the side wall of the tub.

In the preferred embodiment radiused wall portion 80 subtends an arc of about 65° between its tangential juncture with the tub vertical side wall and its juncture at 64 with the dished-out bottom wall 60. The series or row of apertures 84 are located on a predetermined diameter of the order of 21.125 inches as compared to the tub maximum internal diameter of about 22.00 inches. Thus the holes 84 are on a diameter of the order of 96 percent of the tub's side wall internal diameter.

Figure 4:
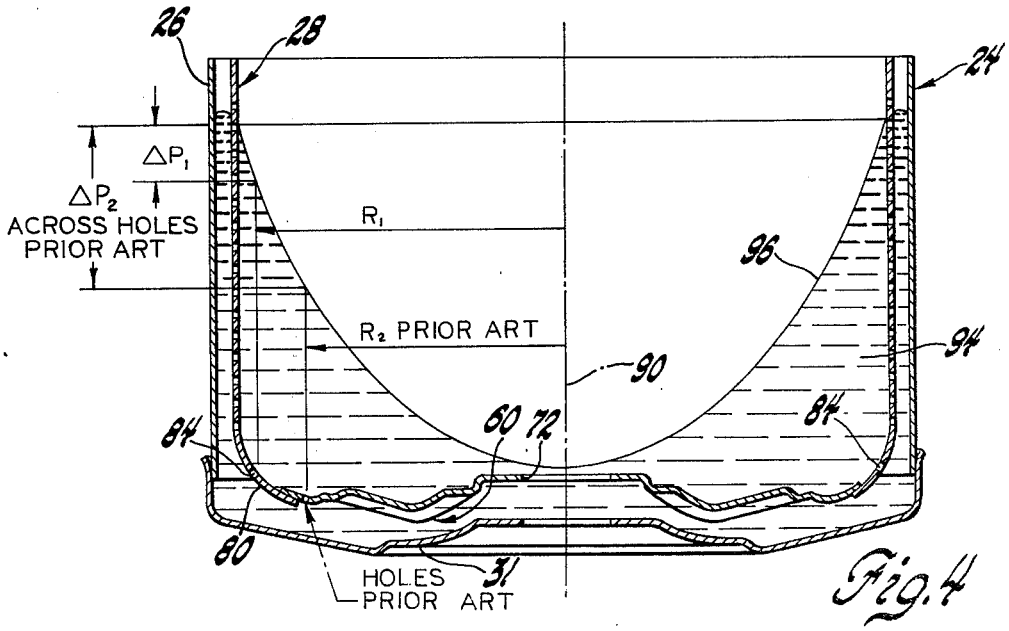
FIG. 4 is a diagrammatic cross-sectional view of the outer water container and inner tub of the clothes washer showing the pressure gradient of the washing fluid within the spin tub during the washer spin cycle.

Tests conducted on prior art vertical agitator washers demonstrate that during the wash cycle particulate or sediment matter in the form of sand, fire clay, etc. washed from the clothes settles in the bottom of the outer water container 24. Upon initiating the spin cycle the clothes are forced centrifugally to the wall of the inner spin tub 28 while the free surface of the water 94 assumes a parabolic shape 96 as seen in FIG. 4. The result is that the water head or pressure at the bottom of the tub 28 is greatest at the side wall and lowest at the center spin axis 90. It was found that the pressure difference or gradient caused a flow of water radially inwardly along the bottom wall of the outer water container 24 for return flow into the spin tub 28 through prior art holes and prior art clearance space in the communication with the tub central opening 72 as disclosed in the Brucken patent. It was observed that such prior art return flow picked-up any sediment matter that had settled in the outer container bottom wall 31 and transported such matter back into the spin tub 24 for redepositing on the clothes as the water was centrifugally forced through the clothes and pumped out to repeat the described flow path.

Applicants discovered that by removing or closing the prior art holes in the spin tub bottom wall 60 together with sealing the opening 72 by means of gasket 78 the unwanted sediment return flow path was closed. Further, that by providing the single row of holes 84 at the location shown resulted in the particulate matter being carried out of the inner tub 28 during the wash cycle.

It ws determined that by locating such single row of holes 84 in the radiused wall portion 80 as shown there existed the velocity vector $V_H$ of the washing fluid outwardly through the holes 84 during the wash cycle of sufficient magnitude to remove from the tub 28 any sediment removed from the clothes. At the same time it was found that with such a location for the single row of holes 84 that a minimum return water flow into the spin tub through the holes 84 existed during the spin cycle. This latter condition is possible because of the improved radial pressure gradient or delta $P_1$ as seen in FIG. 4, compared to the delta $P_2$ of the prior art hole location.

As stated above, as the spin tub is rotating the parabolic water surface 96 represents the water head or the height of the water at any particular radius attempting to force the water outwardly through holes located in the spin tub. Applicants determined that by moving the row of holes 84 outwardly to the radius R not only increased the centrifugal force component $V_H$ sufficiently to force the water outwardly through the sediment removal holes but also resulted in a reduced delta $P_1$ pressure head attempting to force water inwardly through the sediment removal holes. Thus, with the sediment removal holes located at 84 there is a certain delta $P_1$ or pressure differential counteracting the centrifugal force trying to push water inwardly through hole 84. It will be noted, however, that the pressure differential across the prior art holes delta $P_2$ is considerably greater while the centrifugal force represented by radius $R_2$ trying to force water out of the tub is substantially less. For these reasons the prior art arrangement of $R_2$ resulted in a net effect of returning water into the spin tub 28 during the spin cycle causing an unwanted return of the sediment to the clothes.

While the embodiment of the present invention as herein disclosed constitutes a preferred form, it is to be understood that other forms might be adopted.

We claim:

1. In a domestic clothes washer having an imperforate stationary outer water container configured to contain washing fluid and an open-top spin tub nested within said container in spaced relation thereto and having an agitator therein, said spin tub configured to include an imperforate bottom wall having a generally dished configuration, a vertically upwardly extending perforate cylindrical side wall, said bottom and side walls joined by a radiused wall portion extending between the tangential juncture thereof with said side wall and the juncture thereof with said bottom wall, said tub adapted to contain the clothes to be washed in the washing fluid contained by said water container, said tub having a central opening in the bottom wall thereof receiving agitate drive shaft means for said agitator and support means for said tub, said agitate drive shaft means mounting said agitator generally vertically in said spin tub, and drive means selectively drivingly connected to said agitate drive shaft means for vertically reciprocating said agitator and to said support means for rotating said spin tub, said agitator during reciprocation thereof providing pulsating currents of washing fluid radially outwardly in said tub along the bottom wall thereof toward said radiused wall portion and upwardly along said radiused wall portion toward said side wall in a manner to induce toroidal flow of washing fluid in said tub, said spin tub during rotation thereof and due to its configuration and the configuration of said stationary water container when containing washing fluid therein producing a pressure gradient wherein washing fluid pressure is highest at the side wall and lowest at the central opening of said spin tub, the invention comprising means for facilitating sediment removal from said tub in cooperation with the radial pulsating currents of washing fluid, said means including said imperforate bottom wall and means for sealing between the opening means in the bottom wall of said tub and said support means therefor to prevent any of the toroidal flow of washing fluid from passing through said bottom wall during rotation of said tub, said radiused wall portion having a single row of equally spaced and coplanar apertures therein around said tub, said single row of apertures being characterized by a location sufficiently radially outward on said radiused wall portion such that there is a velocity vector of washing fluid outwardly through said single row of apertures during reciprocation of the agitator of sufficient magnitude to remove from said tub any sediment removed from the clothes, and said single row of apertures being further characterized in such sufficiently radially outward location due to said pressure gradient that there is an insufficient velocity vector of washing fluid inwardly through said apertures during rotation of said tub to return to said tub any of the sediment removed previously during reciprocation of said agitator.

* * * * *